United States Patent [19]

Feldman et al.

[11] 4,140,492

[45] Feb. 20, 1979

[54] BORATED DERIVATIVES OF OIL-SOLUBLE MANNICH BASES IN COMBINATION WITH COADDITIVE HYDROCARBONS ARE FLOW IMPROVERS FOR MIDDLE DISTILLATE FUEL OILS

[75] Inventors: Nicholas Feldman, Woodbridge, N.J.; William H. Stover, Sombra; William deWaal, Sarnia, both of Canada

[73] Assignee: Exxon Research & Engineering Co., Florham Park, N.J.

[21] Appl. No.: 836,584

[22] Filed: Sep. 26, 1977

[51] Int. Cl.[2] ..... C10L 1/30

[52] U.S. Cl. ..... 44/62; 44/75

[58] Field of Search ..... 44/72, 73, 80, 62, 75

[56] References Cited

U.S. PATENT DOCUMENTS

| | | | |
|---|---|---|---|
| 3,649,229 | 3/1972 | Otto | 44/73 |
| 3,877,889 | 4/1975 | Dix | 44/73 |
| 3,948,619 | 4/1976 | Worrel | 44/73 |
| 3,955,940 | 5/1976 | Hollyday, Jr. | 44/72 |
| 4,016,092 | 4/1977 | Andress | 44/73 |
| 4,021,207 | 5/1977 | Durand et al. | 44/80 |

*Primary Examiner*—Winston A. Douglas
*Assistant Examiner*—Y. Harris-Smith
*Attorney, Agent, or Firm*—Roland A. Dexter

[57] ABSTRACT

Borated derivatives of $C_8$ to $C_{40}$ hydrocarbyl substituted Mannich bases such as those derived from the condensation reaction of a $C_8$–$C_{40}$ alkyl substituted hydroxy aromatic compound (said alkyl preferably having a linear chain of 16 to 22 carbons), an aldehyde and a mono ($C_2$–$C_3$ alkanol) amine, preferably wherein the molar ratios of said aromatic to said aldehyde to said amine is about 1 to 0.9–1.4 to 0.9–1.4, respectively, are useful in combination with a coadditive hydrocarbon such as an amorphous hydrocarbon or a hydrogenated polybutadiene in improving the cold flow properties of distillate hydrocarbon oils.

7 Claims, No Drawings

BORATED DERIVATIVES OF OIL-SOLUBLE MANNICH BASES IN COMBINATION WITH COADDITIVE HYDROCARBONS ARE FLOW IMPROVERS FOR MIDDLE DISTILLATE FUEL OILS

BACKGROUND OF THE INVENTION

1. Field of the Invention

The invention relates to a borated compound in combination with a coadditive hydrocarbon as middle distillate fuel flow improvers.

2. Description of the Prior Art

Heating oils and other middle distillate petroleum fuels, e.g., diesel fuels, contain normal paraffin hydrocarbon waxes which, at low temperatures, tend to precipitate in large crystals in such a way as to set up a gel structure which causes the fuel to lose its fluidity thereby presenting difficulties in transporting the fuel through flow lines and pumps. The wax crystals that have come out of solution also tend to plug fuel lines, screens and filters. This problem has been well recognized in the past and various additives known as pour point depressants have been used to change the nature of the crystals that precipitate from the fuel oil, thereby reducing the tendency of the wax crystals to set into a gel.

It is known in the prior art to employ various polymeric and copolymeric materials as pour point depressants for controlling wax deposition of wax-containing petroleum fractions e.g. U.S. Pat. No. 3,600,311 teaches that branched alkylene polymers having a molecular weight of about 1,000 to 50,000 and with 10–55% branching, e.g. hydrogenated polybutadiene, can be used to improve the cold flow characteristics of middle distillate fuels.

Recently, it has become known that pour point depression alone is not a sufficient phenomenon to alleviate some problems caused by wax crystals in various fuels, especially middle distillates. In those petroleum fractions, it has been observed that the wax crystals formed in the presence of the pour point depressant are often too large to enable the wax-cloudy fuels to pass easily through screens and orifices commonly encountered in the equipment employed either in distribution or in use of such fuels. This problem has been alleviated by the addition to said fraction of petroleum products of wax crystal modifiers which are referred to as flow and filterability improvers.

U.S. Pat. No. 3,961,916 teaches that the low temperature flow characteristics of petroleum middle distillates can be very satisfactorily controlled by the proper choice of a combination of a nucleating agent or wax growth stimulator and a wax crystal growth arrester.

Other additive combinations have been taught for modifying the cold flow characteristics of petroleum fuels including:

U.S. Pat. No. 3,846,093 teaches modifying the low temperature filterability of middle distillate fuels by the addition of an amorphous hydrocarbon and an N-aliphatic hydrocarbyl succinamic acid or derivative thereof; and, U.S. Pat. No. 4,014,663 teaches a synergistic mixture based on the combination of a hydrocarbon which is a derivative of an alphaolefin and said succinamic acid or derivative thereof.

Mannich bases as petroleum oil additives are known and include those Mannich bases prepared from reaction of an alkyl phenol, aldehyde and a hydroxy amine, e.g. U.S. Pat. No. 3,877,889 teaches Mannich bases derived from hydroxy-containing amines as additives to fuels, including diesel oil and gasoline.

SUMMARY OF THE INVENTION

It has been found that the borated derivative of an oil-soluble Mannich base in combination with a coadditive hydrocarbon of the class consisting of an amorphous hydrocarbon, a hydrogenated butadiene and mixtures thereof further improves the cold flow characteristics of a middle distillate petroleum fuel oil boiling within the range of about 120° C. to about 400° C. at atmospheric pressure.

In accordance with the present invention, a fuel composition is provided which comprises a major proportion, i.e. more than 50% by weight, of a distillate petroleum fraction preferably having an atmospheric boiling range of from about 120° C. to about 400° C. and from about 0.001 to 1.0 wt.% of a flow and filterability improving combination comprising: (a) 1 to 5 parts by weight of a borated oil-soluble Mannich base of the general formula

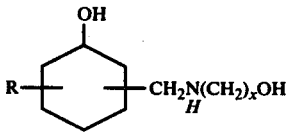

wherein R is an alkyl group having from 8 to 40, preferably 14 to 30, optimally from 16 to 22 carbon atoms and x is an integer ranging from 2 to 10 and (b) 1 to 100 parts by weight of a coadditive hydrocarbon of the class consisting of an oil-soluble amorphous hydrocarbon, such as a saturated hydrocarbon fraction, having less than about 5, preferably less than about 1, wt.% of normal paraffin hydrocarbons, which can be illustrated by Coray 200 petrolatum, a hydrogenated polybutadiene having from about 5 to 55, preferably 10 to 30 weight percent 1-2 addition, i.e. branched units and a number average molecular weight ($\overline{M}_n$) ranging from 400 to 10,000 preferably 600 to 3000 and mixtures thereof. It is preferred that the weight ratio of a/b is in the range of 4:1 to 1:25, optimally 2:1 to 1:8. All molecular weights herein are measured by Vapor Phase Osmometry (VPO).

Concentrates of 1 to 60 wt.% of said borated additive-hydrocarbon combination in 40 to 99 wt.% of mineral oil, e.g. kerosene, can be prepared for ease of handling.

DETAILED DESCRIPTION OF THE INVENTION

The borated flow improver for distillate oils according to this invention is obtained by the reaction of a boron compound with an oil-soluble Mannich base of the formula

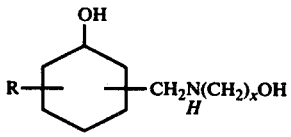

wherein R and x are as previously defined, said base normally being the reaction products of an R (i.e. $C_8$-$C_{40}$ alkyl) substituted hydroxy aromatic compound, an aldehyde and a mono ($C_2$-$C_{10}$ alkanol) amine, e.g. ethanolamine.

ALKYL SUBSTITUTED HYDROXY AROMATIC COMPOUNDS

Representative hydroxy aromatic compounds contemplated by the present invention are phenol, resorcinol, hydroquinone, catechol, cresol, xylenol, benzylphenol, phenyl ethyl phenol, phenol resins, guaiacol, alpha and beta methylnaphthol, tolylnaphthol, xylylnaphthol, benzylnaphthol, anthranol, phenylmethylnaphthol, phenanthrol, methoxyphenol, phenoxyphenol, chlorphenol, and the like. Preference in general is to the monohydroxy phenols otherwise unsubstituted, particular preference being given to phenol and alpha and beta naphthol.

The hydroxy aromatic compounds may also contain one or more substituent groups such as carboxyl, halogen, nitro and the like.

The alkyl substituent contains from about 8 to about 40 carbon atoms. Although linearity of the alkyl substituent is preferred for optimum wax control, branching is acceptable.

These useful alkyl substituted hydroxy aromatic compounds are derived from olefins of 8 to 40 carbon atoms, preferably linear $\alpha$-olefins of 14 to 30 carbon atoms and optimally linear $\alpha$-olefins 16 to 22 carbon atoms reacted with phenol.

Hydroxy aromatic compounds which are substituted by a relatively high molecular weight ($\overline{M}_n$ of 300 to about 600, preferably about 350 to 550) aliphatic hydrocarbon derived from chlorinated wax, such as wax phenols, are useful.

The alkyl substituted phenols of this invention may be made by reacting 1-20, preferably 3-7, optimally 5, moles of a phenol with one mole of a substantially linear olefin (preferably said olefin is an $\alpha$-olefin or oligomers of propylene and/or isobutylene) in the presence of an alkylating catalyst such as $BF_3$, acidic activated clays or strong acid ion exchange resins. The product is conveniently separated from the catalyst by filtration, extraction, etc. Unreacted phenol is removed by distillation, leaving as a residue the product which is over 90% mono-substituted alkyl phenol.

The amount of di- and trialkyl substitution with linear alpha olefin depends on the phenol:olefin mole ratio used and on the catalyst, e.g. at a 5:1 mole ratio of phenol to octadecene-1, about 96% is mono, 4% is di- and 1% is tri- when acidic clay is the catalyst.

ALDEHYDES

Useful aldehydes are the: aliphatic aldehydes, formaldehyde polymers, acetals aldal or aldols typified by formaldehyde and acetaldehyde, paraformaldehyde, methylol, trioxymethylene, and $\beta$-hydroxy butyraldehyde, respectively; aromatic aldehydes, representative of which is benzaldehyde; heterocyclic aldehydes, such as furfural; etc. Preference, however, is given to the aliphatic aldehydes and formaldehyde polymers; formaldehyde and paraformaldehyde being particularly preferred.

AMINES

Amines contemplated by the present invention are monoalkanol amines having 2 to 10 carbons e.g. ethanolamine and isopropanol amine, with the former being preferred.

THE COMPOSITION OF MANNICH BASES

The quality of the additive obtained in the Mannich reaction of this invention depends on the mole ratios of reactants and to reaction temperatures.

The mole ratios useful in this invention, based on the ratios of alkyl substituted aromatic hydroxy compound to aldehyde to amine are 1 to 0.9–1.4 to 0.9–1.4, (preferably 1 to 0.9–1.0 to 0.9–1.0 and optimally 1 to 0.9 to 1.0), respectively.

The desired and useful additive properties of the Mannich bases of this invention may be degraded by reaction temperature conditions (including water removal by nitrogen stripping) in excess of about 135° C.; preferably, the reaction temperatures are maintained at from about 90° C. to about 120° C.

GENERAL REACTION CONDITIONS FOR MANNICH BASE

The reactions were conducted in standard laboratory glass equipment. The alkylphenol, the amine and aldehyde were added to a three-neck flask fitted with a paddle stirrer, reflux condenser and heating mantel with temperature control. The reactants were heated with stirring and heat soaked for from 1 to 8 hours at temperature of from 90° C.–120° C. The product mixture was stripped at a temperature not exceeding 135° C. with nitrogen to remove water and sometimes unreacted aldehyde. Stripping with an inert gas at temperatures ranging from 100° C. to 120° C. is preferred.

When aqueous formaldehyde is used, the bulk of the water can be removed by phase separation prior to nitrogen stripping.

The reaction temperature preferably should be between about 90° C. and 120° C. with range of from 90° C. to 100° C. preferred.

The Mannich base products can be readily filtered with a suitable filter aid.

OIL-SOLUBLE BORATED MANNICH BASE REACTION PRODUCT

The boron compound useful in the reaction with the oil-soluble Mannich bases include boron oxide, boron oxide hydrate, boron acids such as boronic acid [e.g., alkyl-$B(OH)_2$ or aryl-$B(OH)_2$] and boric acids, preferably $H_3BO_3$, and esters of such boron acids.

Specific examples of boronic acids include methyl boronic acid, phenyl-boronic acid, cyclohexyl boronic acid, p-heptylphenyl boronic acid and dodecyl boronic acid.

The boric acid esters include mono-, di- and tri-substituted organic esters of boric acid with alcohols or phenols such as e.g., butanol, octanol, cyclohexanol, cyclopentanol, ethylene glycol, 1,3-butanediol, 2,4-hexanediol, polyisobutene substituted phenols. Lower alcohols, 1,2-glycols, and 1,3-glycols, i.e., those having less than about 8 carbon atoms are especially useful for preparing the boric acid esters for the purpose of this invention. Methods for preparing the esters of boron acid are known.

The general process of forming the oil-soluble borated Mannich bases of the invention by reacting the Mannich base with the boron containing compound is usually carried out by heating a mixture of the reactants at a temperature above about 80° C., preferably within the range from about 100° C. to about 200° C. However, when boric acid or oxide is employed, the process is carried out at a lower temperature (such as 80° C. to 150° C.) preferably at about 120° C. The use of a solvent such as benzene, toluene, naphtha, mineral oil, xylene, n-hexane, or the like is often desirable in the above process to facilitate the control of the reaction temperature and removal of water. Polyols such as ethylene glycol or mannitol, can be used as a cosolvent and/or complexing means for said boron compound, particularly for boric acid or oxide.

The oil-soluble Mannich base reacts readily with the boron compounds, e.g., boric acid, at these mildly elevated temperatures to form the borate complex of the invention. Since the substituted Mannich base in the reaction has two hydroxyl groups and one amide group, the said Mannich base may be complexed with the boron compound in molar ratios of up to 1:3. It is desirable to complex sufficient boron compound with Mannich base to provide from 0.1 to 4, preferably from about 1 to 3, wt.% boron, based on the total weight of the borated complex product of the invention. The boron which appears to be in said product as a boric acid complex apparently attaches or is bonded to the Mannich base as a salt and/or chelate complex. The reaction is carried out to completion which ranges in time from about 0.5 to 10, preferably 1 to 7, hours after which the solvents are removed as by distillation or nitrogen stripping at reaction temperatures.

AMORPHOUS HYDROCARBON

The amorphous hydrocarbon useful in this invention as coadditive with the borated compound is an amorphous, normally solid, essentially saturated hydrocarbon fraction having a number average molecular weight within the range from about 600 to about 3,000, said hydrocarbon fraction being substantially free of normal paraffinic hydrocarbons, preferably having no more than about 1 wt.% of normal paraffins, and having been obtained from a residual petroleum oil. The amorphous hydrocarbon is fully described in U.S. Pat. No. 3,660,058 (see particularly column 2, lines 30 ff) which is incorporated herein by reference thereto.

An amorphous hydrocarbon fraction can be obtained by deasphalting a residual petroleum fraction and then adding a solvent such as propane, lowering the temperature of the solvent-diluted residuum, and recovering the desired solid or semi-solid amorphous product by precipitation, followed by filtration. The residual oil fractions from which the desired amorphous hydrocarbons are obtained will have viscosities of at least 125 SUS at 99° C. Most of these residual oils are commonly referred to as bright stocks.

HYDROGENATED POLYBUTADIENE

Useful hydrogenated polybutadienes are described in U.S. Pat. No. 3,600,311. Hydrogenated polybutadienes are branched polymers which have about 5 to 55, preferably 10 to 30, 1-2 addition and 45 to 95, preferably 70 to 90, 1-4 addition and usefully have a number average molecular weight ($\overline{M}_n$) of 400 to 10,000, are readily prepared by polymerizing butadiene in a suitable solvent, e.g. hydrocarbon, in the presence of an organometallic catalyst, e.g. n-butyl lithium. The resulting polymer is then hydrogenated e.g. with hydrogen in the presence of a nickel catalyst until saturated, e.g. $<1$ weight % unsaturation.

MIDDLE DISTILLATE FUELS

The distillate fuel oils that can be improved by this invention include those having boiling ranges within the limits of about 120° to about 400° C. The distillate fuel oil can comprise straight run or virgin gas or cracked gas oil or a blend in any proportion of straight run and thermally and/or catalytically cracked distillates.

The most common petroleum middle distillate fuels are kerosene, diesel fuels, jet fuels and heating oils. Since jet fuels are normally refined to very low pour points there will be generally no need to apply the present invention to such fuels. The low temperature flow problem is most usually encountered with diesel fuels and with heating oils. A representative heating oil specification calls for a 10 percent distillation point no higher than about 226° C., a 50 percent point no higher than about 272° C., and a 90 percent point of at least 282° C. and no higher than about 338° C. to 343° C., although some specifications set the 90 percent point as high as 357° C. Heating oils are preferably made of a blend of virgin distillate, e.g., gas oil, naphtha, etc., and cracked distillates, e.g., catalytic cycle stock. A representative specification for a diesel fuel includes a minimum flash point of 38° C. and a 90 percent distillation point between 282° C. and 338° C. (See ASTM Designations D-396 and D-975).

The borated additive or additive combination of the invention may be used alone or in combination with still other fuel additives, e.g., corrosion inhibitors; antioxidants, sludge inhibitors, etc.

The invention will be further understood by reference to the following examples which include preferred embodiments of the invention.

EXAMPLES

The following materials were used:

Mannich Base A

Phenol (470 g; 5 mole) was admixed with 66 grams of acidic ion exchange resin (Amberlyst 15 sold by Rohm and Haas of Philadelphia, PA) at 70° C. Thereafter, octadecene-1 (252 g; 1 mole) (sold by Gulf Oil Co., Pittsburgh, PA; a purity of at least 95%) was added slowly while the temperature was maintained between 100–150° C. After an additional 3 hours at 125° C., the catalyst was removed by filtration at from 50–75° C. The product was vacuum stripped by heating at temperatures up to 200° C. at a pressure as low as 20 mm of mercury whereby the unreacted phenol was removed. The product was about 95% by weight o, m and p isomers of octadecylphenol and about 5 wt.% dioctadecylphenol.

Octadecylphenol prepared as above (173 g; 0.5 mole) and ethanolamine (32 g; 0.5 mole) were mixed and thereafter 37% active aqueous formaldehyde (45 g; 0.4 mole) was slowly added to the mixture. The mixture was heated to reflux with stirring and held there for an additional 6 hours. The system was cooled, to 50 ml of toluene added with agitation after which phase separation was allowed to take place. After removal of the aqueous phase, 50 ml of water was added with agitation and once again phase separation was allowed to take place. The aqueous phase was withdrawn and the oil phase vacuum stripped at a pressure of about 25 mm of mercury to a pot temperature of 125° C. The product was a clear amber liquid having a total base number (TBN) (ASTM 2896) of 97 mg KOH/g which liquid is hereafter referred to as Mannich Base A.

BORATED MANNICH BASE A

The product was prepared by first dissolving 4 grams of the clear amber liquid of Mannich Base A in 160 ml of toluene and thereafter adding 7 ml of a 8 wt.% solution of boric acid in ethylene glycol. The mixture was refluxed while being stirred, for six hours, after which time the solvents were distilled off leaving 4.6 g of a boron containing compound which analyzed about 2.0 wt.% boron which compound is hereafter referred to as Borated Mannich Base A.

MANNICH BASE B

Octadecylphenol prepared as in the making of Mannich Base A (346 g; 1 mole), paraformaldehyde (31.2 g; 1.04 mole) and diethanolamine (99.7 g; 0.95 mole) were admixed slowly with stirring so as to maintain the temperature less than about 40° C. The reactants were heated to about 100° C. and held there for about 4 hours with stirring. The product was then stripped of water using nitrogen up to 120° C. for about 0.5 hours. The product was filtered to remove insolubles. After filtration, the additive was a clean amber liquid with a total base number (ASTM 2896) of 110 mg KOH/g hereafter referred to as Mannich Base B.

BORATED MANNICH BASE B

Mannich Base B was borated as by the same procedure as for Borated Mannich Base A to yield after distillation 4.2 g of a boron containing compound which analyzed about 2.1 wt.% boron which compound is hereafter referred to as Borated Mannich Base B.

HYDROGENATED POLYBUTADIENE

The hydrogenated polybutadiene had an ($\overline{M}_n$) of about 1250, a Bromine No. of 0.3 and a Fisher-Johnes melting point of 33–44° C. The hydrogenated polybutadiene was prepared with a n-butyl lithium catalyst and hydrogenated with hydrogen in the presence of a Raney nickel catalyst.

AMORPHOUS HYDROCARBON An amorphous hydrocarbon fraction (m.p. 43.9 g.) obtained by propane precipitation from the deasphalted residuum of a Texas coastal crude oil was found by mass spectrographic analysis, and by gas chromatography, to contain 5 wt.% of isoparaffins, 22 wt.% of aromatic hydrocarbons, 73% of cycloparaffins, and no more than a trace of normal paraffin hydrocarbons. The number average molecular weight of this material was about 775 as determined by osmometry.

The distillation characteristics of this solid hydrocarbon fraction were as follows:

Table I

| Distillation (ASTM D-1160) | Vapor Temp. at 5 mm Hg | Vapor Temp. Converted to Atmospheric Pressure |
|---|---|---|
| Initial BP | 228° C. | 401° C. |
| 5% | 310° C. | 497° C. |
| 10% | 336° C. | 526° C. |
| 20% | 364° C. | 557° C. |
| 24% | 365° C. | 558° C. |

Only 24% would distill over.
There were 75% bottoms and 1% loss

FUEL

The properties of the middle distillate fuel tested is summarized in Table II which follows:

Table II

| | |
|---|---|
| Cloud Point, ° C. | +1 |
| Gravity, API | 32.1 |
| Aniline Point | 71° C. |
| Distillation, ° C. (per ASTM D-86) | |
| IBP | 158 |
| 5% | 189 |
| 50% | 265 |
| 95% | 342 |
| FBP | 350 |

Blending of the additives into the fuel was accomplished by their dissolution into the fuel oil. This was done while warming, e.g. heating the oil and additive to about 90° C. if the additive or mixture of additives per se were added, and stirring.

The blends were then tested for their cold flow properties in the test described below.

THE COLD FILTER PLUGGING POINT TEST (CFPPT)

The cold flow properties of the blend were determined by the Cold Filter Plugging Point Test (CFPPT). This test is carried out by the procedure described in detail in "Journal of the Institute of Petroleum," Volume 52, Number 510, June 1966 pp. 173–185. In brief, a 40 ml. sample of the oil to be tested is cooled by a bath maintained at about −34° C. Periodically (at each one degree Centigrade drop in temperature starting from 2° C. above the cloud point) the cooled oil is tested for its ability to flow through a fine screen in a time period. This cold property is tested with a device consisting of a pipette to whose lower end is attached an inverted funnel positioned below the surface of the oil to be tested. Stretched across the mouth of the funnel is a 350 mesh screen having an area of about 0.45 square inch. The periodic tests are each initiated by applying a vacuum to the upper end of the pipette whereby oil is drawn through the screen up into the pipette to a mark indicating 20 ml. of oil. The test is repeated with each one degree drop in temperature until the oil fails to fill the pipette within 60 seconds. The results of the test are reported as the temperature in ° C. at which the oils fail to fill the pipette in the prescribed time.

The blends prepared and the test results are summarized in Table III which follows:

TABLE III

EFFECTIVENESS OF ADDITIVES IN THE FUEL

| Example | Wt. % a.i. | Additive | CFPPT ° C. |
|---|---|---|---|
| 1 | — | none | 0 |
| 2 | 0.05 | Mannich Base A | 0 |
| 3 | 0.10 | Mannich Base A | 0 |
| 4 | 0.05 | Borated Mannich Base A | −2 |
| 5 | 0.10 | Mannich Base B | −1 |
| 6 | 0.10 | Mannich Mannich Base B | −1 |
| 7 | 0.05 | Mannich Hydrocarbon | −3 |
| 8 | 0.10 | Amorphous Hydrocarbon | −4 |
| 9 | 0.15 | Amorphous Hydrocarbon | −6 |
| 10 | 0.05 | Hydrogerated Polybutadiene | −3 |
| 11 | 0.10 | Hydrogenated Polybutadiene | −7 |
| 12 | 0.05<br>0.10 | Mannich Base A<br>Amorphous Hydrocarbon | −6 |
| 13 | 0.05<br>0.10 | Borated Mannich Base A<br>Amorphous Hydrocarbon | −12 |
| 14 | 0.05<br>0.05 | Mannich Base A<br>Hydrogenated Polybutadiene | −6 |

TABLE III-continued

EFFECTIVENESS OF ADDITIVES IN THE FUEL

| Example | Wt. % a.i. | Additive | CFPPT ° C. |
|---|---|---|---|
| 15 | 0.05<br>0.05 | Borated Mannich Base A<br>Hydrogenated Polybutadiene | −11 |
| 16 | 0.05<br>0.10 | Mannich Base B<br>Amorphous Hydrocarbon | −7 |
| 17 | 0.05<br>0.10 | Borated Mannich Base B<br>Amorphous Hydrocarbon | −6 |
| 18 | 0.05<br>0.05 | Mannich Base B<br>Hydrogenated Polybutadiene | −4 |
| 19 | 0.05<br>0.05 | Borated Mannich Base B<br>Hydrogenated Polybutadiene | −4 |

The enhanced results obtained by the teachings of this invention are apparent from the foregoing Table III if a comparison is made between Example 12 and Example 13 where the CFPPT° C. is reduced 6° C. through the practice of this invention and by a comparison of Example 14 with Example 15 where a decrease of 5° C. is realized. Further, a comparison of Examples 13 and 15 with Examples 17 and 19, respectively, shows that the borated amino monoalkoxy Mannich base has enhanced useful activity with the coadditive hydrocarbon whereas the borated amino dialkoxy Mannich base does not show such enhanced combined activity.

The invention in its broader aspect is not limited to the specific details shown and described and departures may be made from such details without departing from the principles of the invention and without sacrificing its chief advantages.

What is claimed is:

1. A fuel composition comprising a major proportion of a distillate petroleum fraction having an atmospheric boiling range of from about 120° C. to about 400° C. and from about 0.01 to 1.0 wt.% of a flow and filterability improving combination comprising: (a) 1 to 5 parts by weight of borated oil-soluble Mannich base of the general formula

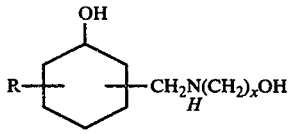

wherein R is an alkyl group having from 8 to 40 carbon atoms and x is an integer ranging from 2 to 10; and (b) 1 to 100 parts by weight of a coadditive hydrocarbon of the class consisting of an oil-soluble amorphous hydrocarbon having less than about 5 wt.% of normal paraffin hydrocarbons, a hydrogenated polybutadiene having a number average molecular weight ranging from 400 to 10,000 and mixtures thereof.

2. A fuel composition according to claim 1 wherein said borated Mannich base is boron complexed with the reaction product of a $C_8$-$C_{40}$ alkyl substituted hydroxy aromatic compound, an aldehyde and a mono($C_2$-$C_3$ alkoxy) amine wherein the molar ratio of said aromatic to aldehyde to amine is about 1 to 0.9–1.4 to 0.9–1.4, respectively, and in an amount of from about 0.1 to 4 wt.% boron.

3. A fuel composition according to claim 1 wherein the weight ratio of said (a) to said (b) ranges from 4:1 to 1:25.

4. The composition of claim 1 wherein said alkyl substituent contains a substantially linear chain of from 14 to 30 carbons.

5. The composition of claim 2 wherein said amine is ethanolamine and said hydrocarbon is hydrogenated polybutadiene having a ($\overline{M}_n$) ranging from 600 to 3,000.

6. An additive concentrate comprising from about 1 to 60 wt.% of an additive combination consisting essentially of from 1 to 5 parts by weight of borated oil-soluble Mannich base of the general formula

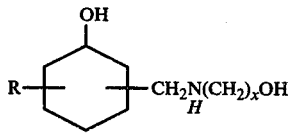

wherein R is an alkyl group having from 8 to 40 carbon atoms and x is an integer ranging from 2 to 10; and from 1 to 100 parts by weight of an oil-soluble amorphous hydrocarbon having less than about 5 wt.% of normal paraffin hydrocarbons dissolved in a hydrocarbon solvent.

7. A borated oil-soluble Mannich base of the general formula

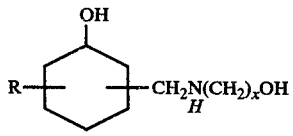

wherein R is an alkyl group having from 8 to 40 carbon atoms and x is an integer ranging from 2 to 10; and containing from about 0.1 to 4 weight percent boron.

* * * * *